US005363922A

United States Patent [19]

Al-Megren

[11] Patent Number: 5,363,922

[45] Date of Patent: Nov. 15, 1994

[54] DEVICE AND METHOD FOR INSTALLING A SUBMERGED WATER PUMP IN AN ARTESIAN WELL

[76] Inventor: Abdulaziz A. Al-Megren, P.O. Box 5789, Riyadh 11432, Saudi Arabia

[21] Appl. No.: 31,556

[22] Filed: Mar. 15, 1993

[51] Int. Cl.[5] ..... E21B 43/00

[52] U.S. Cl. ..... 166/380; 166/68

[58] Field of Search ..... 166/378, 380, 381, 385, 166/67, 68, 68.5

[56] References Cited

U.S. PATENT DOCUMENTS

| | | | |
|---|---|---|---|
| 4,475,872 | 10/1984 | Foughty | 166/68.5 X |
| 4,751,969 | 6/1988 | Klaeger | 166/68 X |
| 4,830,113 | 5/1989 | Geyer | 166/380 X |

*Primary Examiner*—Thuy M. Bui
*Attorney, Agent, or Firm*—Ladas & Parry

[57] ABSTRACT

The invention relates to a device and method for installing a submerged water pump in an artesian well at a desired depth or lifting the pump to do necessary maintenance in an easy manner. The device has two portions, an upper portion and a lower portion. The upper portion is, in general, simple slinging and lifting mechanical devices whereas the lower portion has the configuration of an iron core of a car wheel surrounded by a rubber tire which is supplied with compressed air from an air supply source outside the well. The pump is fitted to the lower side or base of the lower portion and lowered into the well to the desired depth by the upper portion of the device before the tire is supplied with the compressed air. The tire is then supplied with the compressed air and, as a result, inflates to extend against the inside wall of the casing of the well. This fits or installs the pump against movement at the desired depth until the compressed air is released, the tire deflates and the pump is lifted from the well by the upper portion of the device.

10 Claims, 3 Drawing Sheets

DEVICE AND METHOD FOR INSTALLING A SUBMERGED WATER PUMP IN AN ARTESIAN WELL

BACKGROUND OF THE INVENTION

The invention relates in general to a device to install a submerged water pump in an artesian well. In particular, this invention relates to a device and method for installing a submerged pump in an artesian well at the desired depth or lifting the said pump to perform the necessary maintenance in an easy and quick manner.

Artesian wells in the Kingdom of Saudi Arabia are considered one of the main sources for supplying farms, schools, hospitals, and residential communities in remote areas with water. Therefore, it was necessary to ensure a continuous supply of water to these communities as is difficult to rely on another sources. Water is pumped from an artesian well using a submerged pump which is lowered inside the well using short metal pipes attached to each others. When the pump is out of order and has to be fixed it is lifted using heavy lifting equipment, then the pipes are dismantled and the pump is fixed. The pipes are attached to each other again and the pump is lowered in the well again.

No doubt this process is tedious and time consuming. Notwithstanding the necessity of skilled workers and heavy equipments. Also, the metal pipes are expensive and must be in accordance with certain specifications. One of the problems encountered in this field is the damage of connections connecting the pipes, and sometimes the falling of the pump inside the well.

This invention overcomes the disadvantages of prior art by providing a device for installing a submerged pump inside an artesian well at the desired depth or which can be used to lift the pump to perform the necessary maintenance in an easy and rather simple manner.

The invention also aims at excluding mantling and dismantling equipments associated with prior art methods.

Also the invention aims at minimizing fixing and maintenance time in order to ensure the continuous supply of water to farms, hospitals, schools and residential communities in remote areas.

Another object of this invention is to bring the total cost of operating artesian wells to a minimum by excluding the use of expensive metal pipes.

General Description of this Invention

This invention relates to a device and method for installing a submerged pump in an artesian well by which one can install the said pump at the desired depth or lifting the pump to perform the necessary maintenance in an easy and quick manner which overcomes prior art.

The device, the subject of this invention, consists of two groups, an upper group and a lower group. The upper group (the tension and slinging group) consists of a drainage cover with a base which looks like a round disk. The round disk contains openings for discharging water and an opening for entry of slinging iron rope. The radius of the drainage cover becomes smaller and smaller as we go up until it reaches a point where it is connected to a water discharge pipe which is bent 90 degrees and discharges water sideways.

The lower group consists substantially of a metal pipe with two round disks attached to its ends. The lower group has in general the configuration of the iron core of a car wheel. A rubber tire is fitted on the said iron core and is supplied with compressed air from a source outside the well. The submerged pump is fitted to the lower disk of the iron core. After slinging the lower group to the desired depth, the tire is blown up with compressed air. The rubber tire will extend against the inside wall of the casing of the well forming a good seal and preventing any movement of the pump during operation. When it is desired to bring the pump out of the well for fixing or maintenance, air is discharged partially from the tire and the pump is pulled out of the well using a suitable winch.

The features and other advantages of this invention will be apparent from the following detailed description and appended drawings.

DETAILED DESCRIPTION OF THE PREFERRED EMBODIMENTS

Figure 1:
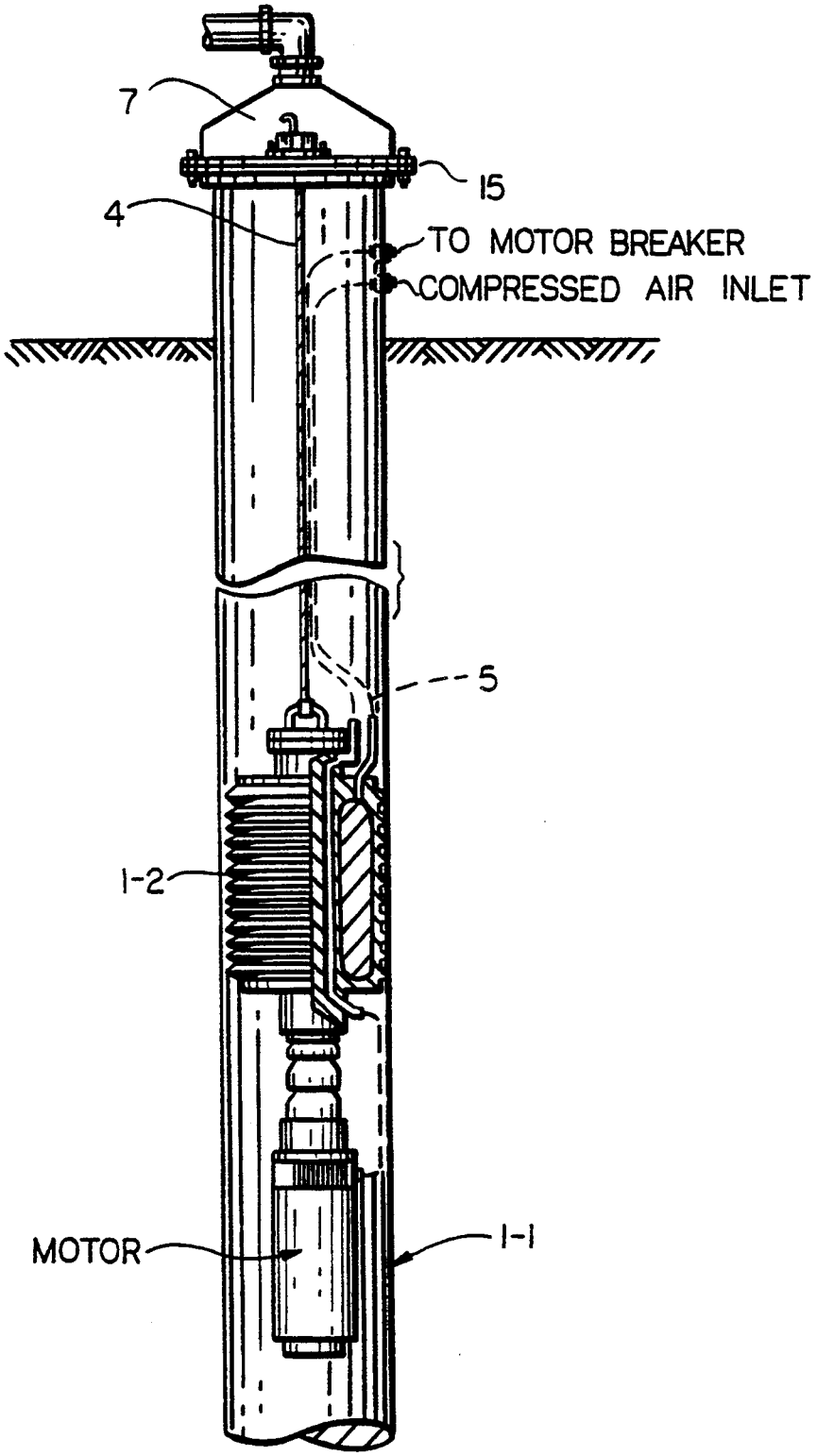
FIG. 1: A view of an artesian well wherein a submerged pump has been installed inside it at a certain depth using the device according to this invention.
Figure 2:
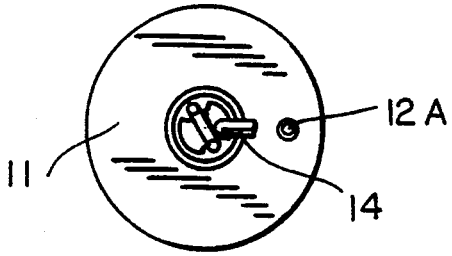
FIG. 2: Plan view of the upper disc in the lower group.

FIG. 1 shows an embodiment of this invention wherein the device according to the invention has been installed inside an artesian well (1—1) at the desired depth. The device consists of two groups. An upper group and a lower group. The upper group consists of a drainage cover (7), an iron rope (4) to lower the pump down the well or to lift it by pulling the iron rope using a suitable winch. The lower group consists of a metal pipe with two metal discs attached to its ends, an upper disc (1-4) and a lower disc (1-5). The metal pipe looks like the iron core of a car wheel. In the upper disc of the iron core there is an opening which allows the entry of the electric cable of the submerged pump. As can be seen from FIG. 2 which is a plan view of the upper disc of the lower group, the disc is fitted on to the pipe using bolts and nuts. While the lower disc is fitted on the outside surface of the pipe which is threaded on its lower end.

Figure 5:
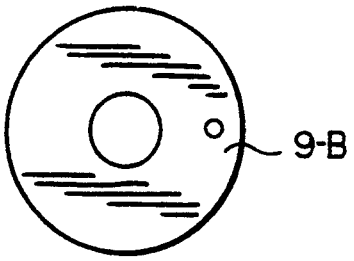
FIG. 5: Plan view of the rubber tire.
Figure 6:
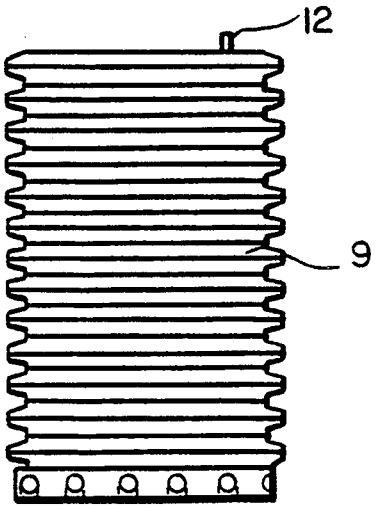
FIG. 6: Side view of the rubber tire.
Figure 4:
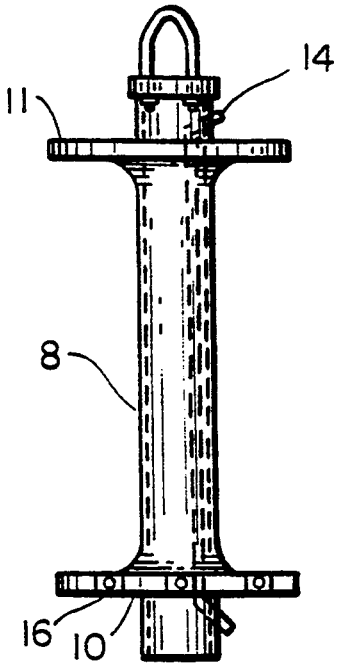
FIG. 4: Side view of the iron core which looks like an iron core of a car wheel.
Figure 7:
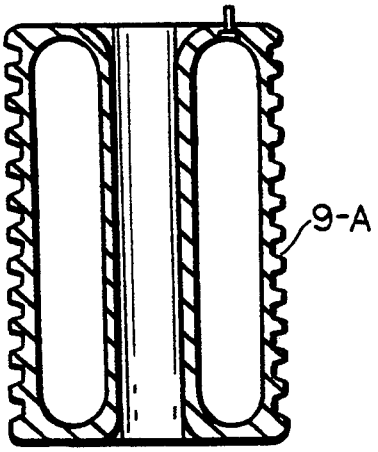
FIG. 7: Cross-sectional view of the rubber tire.
Figure 3:
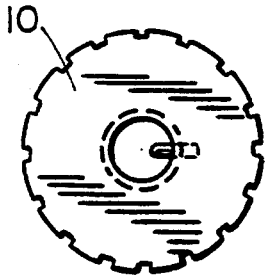
FIG. 3: Plan view of the bottom disc of the lower group.
Figure 8:
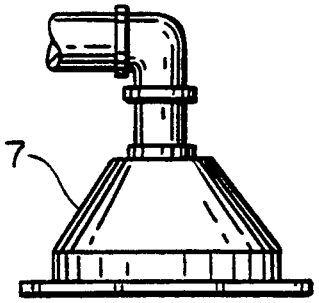
FIG. 8: Side view of the drainage cover with a plan view of its base.
Figure 9:
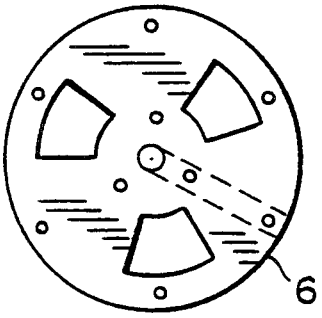
FIG. 9: Plan view of the base of the drainage cover with openings for discharging water.
Figure 10:
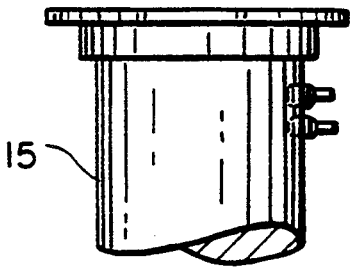
FIG. 10: Side view of the upper part of the tube used for pumping water from the artesian well.

The rubber tire shown in the FIGS. 5, 6 and 7 is similar in general to a car wheel tire (FIG. 5).

However there is provided on its outer surface circular protrusions which enhance the sealing effect between the tire and tile inside wall of the casing of the well (FIGS. 6 and 7). The tire must withstand an air pressure of at least 100 bars.

An artesian well must be prepared in a special manner before water can be pumped out of it. A metal casing should be provided inside tile well and the space between the outside surface of the said metal casing and the wall of the well must be filled with concrete. This arrangement will prevent any slide of the walls of the well. The casing should be made from a substance which does not corrode as a result of being exposed to water.

In all cases the dimensions of the device according to the invention must be such that the device can be fitted inside the specified well.

After completing the necessary steps of preparing the well for use, the pump is attached to the lower disc of the lower group. The electric cable is passed through the opening in the upper disc and is connected to the tire as shown in FIG. 1.

The iron rope is connected to the rack (13) and the device is lowered down the well until it reaches the desired depth.

The drainage cover is put in its place as shown in FIG. 1 and the rubber tire is blown with air until it touches the inside wall of the casing of the well and forms a good seal.

At this moment the pump is actuated and water will rise through the pipe (1—1) shown in FIG. 1 and is discharged outside the well using a suitable discharge tube.

It should be understood that more than one pump can be used in a single well especially in deep wells, where a single pump might not be able to pump water the desired height.

When it is desired to perform any maintenance the pump is lifted using a suitable winch after discharging air partially from the rubber tire.

It should be understood that certain modifications can be made without departing from the scope of this invention as described herein and in the appended claims.

I claim:

1. A device for installing a submerged pump in an artesian well at a desired depth and lifting the pump therefrom, the device comprising:

fitting means which has the general shape of an iron core of a car wheel for releasably installing a pump at a desired depth in an artesian well and slinging and lifting means for lifting the fitting means from the well.

2. The device for installing a submerged pump according to claim 1 wherein the slinging and lifting means comprises a drainage cover for the well, a discharge tube for the Dump, an iron rope to the core and a winch on the rope while the fitting means comprises a metal pipe with two discs attached to its ends and a rubber tire which is fitted on the iron core for supply with compressed air from a source outside the well.

3. A device for installing a submerged pump according to claim 2 wherein the rubber tire should withstand an air pressure of 100 bars, at least.

4. In a device for installing a submerged pump in an artesian well, the improvement comprising:

pump-holding means in the general shape of a core of a car wheel for holding the pump; and tire means on the core for inflation against an inside wall of a well, whereby to install the pump in the well.

5. The device according to claim 4, and further comprising:

slinging and lifting means for lowering the pump-holding means and, thereby, the pump to a desired depth in the well before the installation.

6. The device according to claim 4, wherein the tire means is also for deflation from against the inside wall of the well, and further comprising slinging and lifting means for raising the pump-holding from a depth of the installation in the well.

7. The device according to claim 5, wherein the tire means is also for deflation from against the inside wall of the well, and the slinging and lifting means for raising the pump-holding from the desired depth of the installation in the well.

8. A method of installing a submerged pump in an artesian well at a desired depth and lifting the pump therefrom, the method comprising:

releasably installing a pump at a desired depth in an artesian well with fitting means which has the general shape of an iron core of a car wheel and lifting the fitting means from the well with slinging and lifting means.

9. The method of installing a submerged pump according to claim 8 wherein the lifting comprises providing a drainage cover for the well, providing a discharge tube for the pump, providing an iron rope to the core and providing a winch on the rope while the installing comprises providing a metal pipe with two discs attached to its ends and providing a rubber tire which is fitted on the iron core for supply with compressed air from a source outside the well.

10. The method of installing a submerged pump according to claim 9, further comprising the step of providing said rubber tire with an inflation capacity of at least 100 bars.

* * * * *